US008950483B2

(12) United States Patent
Mason et al.

(10) Patent No.: US 8,950,483 B2
(45) Date of Patent: Feb. 10, 2015

(54) SYSTEM AND METHOD FOR UMBILICAL-LESS POSITIONAL FEEDBACK OF A SUBSEA WELLHEAD MEMBER DISPOSED IN A SUBSEA WELLHEAD ASSEMBLY

(75) Inventors: Guy Harvey Mason, Hook (GB); Stephen Paul Fenton, Balmedie (GB)

(73) Assignee: Vetco Gray U.K. Limited, Bridge of Don, Aberdeen (GB)

( * ) Notice: Subject to any disclaimer, the term of this patent is extended or adjusted under 35 U.S.C. 154(b) by 390 days.

(21) Appl. No.: 13/548,891

(22) Filed: Jul. 13, 2012

(65) Prior Publication Data

US 2014/0014334 A1 Jan. 16, 2014

(51) Int. Cl.
*E21B 47/092* (2012.01)

(52) U.S. Cl.
USPC ..... 166/255.1; 166/348; 166/379; 166/382; 166/75.14

(58) Field of Classification Search
USPC ..... 166/338, 341, 342, 344, 345, 348, 166/255.1, 255.2, 379, 380, 382, 86.1, 166/75.14, 208
See application file for complete search history.

(56) References Cited

U.S. PATENT DOCUMENTS

| | | | | | |
|---|---|---|---|---|---|
| 4,058,166 | A | * | 11/1977 | Crickmer | 166/382 |
| 4,121,657 | A | | 10/1978 | McClure | |
| 4,665,979 | A | * | 5/1987 | Boehm, Jr. | 166/208 |
| 4,742,874 | A | * | 5/1988 | Gullion | 166/348 |
| 4,862,426 | A | * | 8/1989 | Cassity et al. | 367/81 |
| 4,932,472 | A | * | 6/1990 | Boehm, Jr. | 166/208 |
| 4,949,786 | A | * | 8/1990 | Eckert et al. | 166/208 |
| 4,960,172 | A | * | 10/1990 | Nelson | 166/208 |
| 5,060,724 | A | * | 10/1991 | Brammer et al. | 166/208 |
| 5,456,314 | A | | 10/1995 | Boehm, Jr. et al. | |
| 5,666,050 | A | | 9/1997 | Bouldin et al. | |
| 6,041,864 | A | * | 3/2000 | Patel et al. | 166/332.4 |
| 6,343,649 | B1 | * | 2/2002 | Beck et al. | 166/250.01 |
| 6,725,924 | B2 | * | 4/2004 | Davidson et al. | 166/250.01 |
| 7,513,308 | B2 | | 4/2009 | Hosie et al. | |
| 7,762,338 | B2 | * | 7/2010 | Fenton et al. | 166/348 |
| 8,733,448 | B2 | * | 5/2014 | Skinner et al. | 166/373 |
| 2002/0189806 | A1 | * | 12/2002 | Davidson et al. | 166/250.01 |
| 2007/0039738 | A1 | | 2/2007 | Fenton et al. | |
| 2007/0170914 | A1 | | 7/2007 | Gissler | |
| 2007/0170915 | A1 | * | 7/2007 | Gissler | 324/207.24 |

(Continued)

FOREIGN PATENT DOCUMENTS

EP 2312116 A2 4/2011

OTHER PUBLICATIONS

GB Search Report and Written Opinion dated Dec. 23, 2013 from corresponding Application No. GB1312391.4.

*Primary Examiner* — Blake Michener
(74) *Attorney, Agent, or Firm* — Bracewell & Giuliani LLP

(57) ABSTRACT

A positional feedback system includes a seal assembly coupled to a running tool, the seal assembly having a seal ring and an energizing ring positioned between a hanger and a subsea wellhead. The energizing ring moves relative to the seal ring from an unset position to a set position to seal to the wellhead and the hanger. The system includes a magnet disposed on the energizing ring and having a magnetic field. One or more sensing devices are disposed on running tool and positioned in the magnetic field of the magnet in the set position and the unset position. The sensing devices are configured to communicate with a surface platform when the rare earth magnet passes a magnetic field through the sensing devices.

21 Claims, 4 Drawing Sheets

(56) References Cited

U.S. PATENT DOCUMENTS

2007/0267221 A1* 11/2007 Giroux et al. ..... 175/57
2011/0278018 A1 11/2011 Fenton et al.
2012/0098203 A1* 4/2012 Duong ..... 277/322
2012/0186829 A1* 7/2012 Watson ..... 166/382

* cited by examiner

SYSTEM AND METHOD FOR UMBILICAL-LESS POSITIONAL FEEDBACK OF A SUBSEA WELLHEAD MEMBER DISPOSED IN A SUBSEA WELLHEAD ASSEMBLY

BACKGROUND OF THE INVENTION

1. Field of the Invention

This invention relates in general to a system for remote positional feedback of a subsea wellhead member and, in particular, to a system and method to detect the position of an actuable member of a subsea wellhead member for confirmation of setting of the subsea wellhead member.

2. Brief Description of Related Art

Operators have long desired to know what actions are transpiring within the well. As a result of this desire, many tools and apparatuses have been developed to transmit information from subsea locations to the operator at the surface. For example, during measurement while drilling operations (MWD), mud pulse technologies may be used to sonically transmit data through the drill string to an operator at the surface. Still other MWD operations may transmit data from subsea transmitters through electromagnetic pulses through the drill string. In this manner, operators may receive information about what is transpiring within the wellbore during drilling operations. However, these transmission methods only provide a means to transmit basic information about downhole activities back to the surface. These transmission technologies do not currently allow for real time transmission of data, nor do they allow for communication with, or control of, the tool from the surface.

Operators may also wish to know what is transpiring within the wellhead as the casing string and/or production tubing string is run, landed, locked, and cemented within the wellbore. This is particularly true in subsea environments where the wellhead and casing landing locations may be thousands of feet below the surface of the ocean. In one example, to determine if the tubing hanger has landed and locked, prior art embodiments will run the tubing hanger to the expected location within the wellhead. Then, the prior art embodiments perform the necessary procedures to lock the tubing hanger to the wellhead. The embodiments then conduct an overpull, i.e. pulling up on the running string suspending the tubing hanger running tool and the tubing hanger in the wellhead, to confirm that the tubing hanger has landed and locked within the wellhead. However, this is an imprecise measurement, and may provide a false indication of proper landing and locking. This is possible where the tubing hanger dogs did not properly engage the wellhead, causing the dogs to initially indicate proper locking through overpull, but the dogs then moving from the properly engaged position following execution of the test.

Another prior art method to confirm downhole operations, i.e. tubing and casing hanger landing and tubing and casing hanger locking, involves monitoring well fluids returning from the well to the operating rig. The tubing hanger will include an actuation sleeve that engages tubing hanger dogs with a profile in the wellhead. The actuation sleeve is actuated hydraulically, and when fluid returns through the running string following performance of the land and lock operations, it is assumed that the tubing hanger has properly locked in the wellhead. However, the return of fluid through the tubing string only means that the actions have been performed, not that they operated properly or that the tubing hanger properly locked in the wellhead.

Unfortunately, these prior art embodiments fail to provide direct confirmation of downhole operations, such as landing and locking. Often, the tool must be pulled to verify that the desired downhole operation has taken place. This can often take an entire day to run the tool to the location, perform an operation, and then pull the tool to verify landing and locking. If the tool did not perform properly, then only after pulling the tool does the operator know and become able to take corrective action. Therefore a system that could provide direct communication of downhole subsea operations, such as casing hanger landing and locking, is desirable.

In addition, prior art tools may not provide feedback of vertical elevation of a hanger and running tool assembly disposed within a riser. Knowing this information may be particularly relevant as the hanger and running tool assembly are negotiated through the drilling riser at the flex joint immediately above the blowout preventer stack. At this location, knowledge of the angle of the drilling riser relative to the blowout preventer stack is critical to assure passage of the hanger and running tool assembly through the blowout preventer stack without damaging either the blowout preventer stack or the hanger and running tool assembly. Therefore, a system that could provide vertical elevation information regarding the hanger within the riser prior to landing is desirable.

SUMMARY OF THE INVENTION

These and other problems are generally solved or circumvented, and technical advantages are generally achieved, by preferred embodiments of the present invention that provide a system and method for umbilical-less positional feedback of a subsea wellhead member disposed in a subsea wellhead assembly.

In accordance with an embodiment of the present invention, a positional feedback system having a wellhead, a tubing hanger disposable within the wellhead, and a running tool configured to set the tubing hanger in the wellhead is disclosed. The system includes a seal assembly releasably coupled to the running tool. The seat assembly has a seal ring and an energizing ring and is configured to be positioned between an outer diameter surface of the tubing hanger and an inner diameter surface of the wellhead. The energizing ring is configured to be moved relative to the seal ring from an unset position to a set position to set the seal ring and form a seal between the seal ring and the inner and outer diameter surfaces of the wellhead and the tubing hanger, respectively. A rare earth magnet having a magnetic field is disposed on the energizing ring. The system also includes one or more sensing devices disposed on running tool. The one or more sensing devices are positioned in the magnetic field of the rare earth magnetic in one or more of the set position and the unset position. The one or more sensing devices are configured to communicate with a surface platform when the rare earth magnet passes a magnetic field through the one or more sensing devices.

In accordance with another embodiment of the present invention, a positional feedback system having a wellhead, a wellhead member disposable within the wellhead, and a running tool configured to set the wellhead member in the wellhead is disclosed. The system includes an actuable member releasably coupled to the running tool, the actuable member configured to be moved from an unset position to a set position to set the wellhead member in the wellhead. The system also includes a rare earth magnet having a magnetic field. The rare earth magnet is disposed on the actuable member. The system further includes one or more sensing devices disposed on running tool. The one or more sensing devices are positioned in the magnetic field of the rare earth magnetic in one or more of the set position and the unset position. The one or more sensing devices are configured to communicate with a surface platform when the rare earth magnet passes a magnetic field through the sensing device.

In accordance with yet another embodiment of the present invention, a method for determining a positional location of an actuable member of a subsea wellhead member is disclosed. The method provides a tubing hanger disposable within the wellhead, and a running tool configured to set the tubing hanger in the wellhead. The method also provides a seal assembly releasably coupled to the running tool, the seal assembly having a seal ring and an energizing ring. The method mounts a rare earth magnet to the energizing ring, and one or more sensing devices on the running tool, and positions the seal assembly between an outer diameter surface of the tubing hanger and an inner diameter surface of the wellhead. The method moves the energizing ring relative to the seal ring from an unset position to a set position to set the seal ring and form a seal between the seal ring and the inner and outer diameter surfaces of the wellhead and the tubing hanger, respectively. The method passes a magnetic field of the rare earth magnet through the one or more sensing devices disposed on running tool; and communicates a signal to the surface platform in response to passing the magnetic field of the rare earth magnet through the one or more sensing devices, the signal indicating positional location of the energizing ring.

An advantage of a preferred embodiment is that it provides remote feedback of status of riser tool and hanger lockdown status during installation, allowing for confirmation of proper landing and activation of in-riser members. The disclosed embodiments accomplish this task without requiring a dedicated umbilical. Thus, the disclosed embodiments are simpler and avoid risks associated with mechanical damage to a dedicated umbilical during installation operations. Still further, the disclosed embodiments reduce deployment time by removing the required element of deployment and retrieval of a dedicated umbilical in addition to the riser tool. In yet another advantage, the disclosed embodiments communicate vertical elevation of the hanger and riser tool relative to a drilling riser flex joint during running to the landing string or completion assembly.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

In the following discussion, numerous specific details are set forth to provide a thorough understanding of the present invention. However, it will be obvious to those skilled in the art that the present invention may be practiced without such specific details. Additionally, for the most part, details concerning rig operations, wellbore drilling, wellhead placement, and the like have been omitted inasmuch as such details are not considered necessary to obtain a complete understanding of the present invention, and are considered to be within the skills of persons skilled in the relevant art. As used herein, terms such as above and below are used to describe relative position of components of the invention as illustrated and are not intended to limit the disclosed embodiments to a vertical or horizontal orientation.

Figure 1:
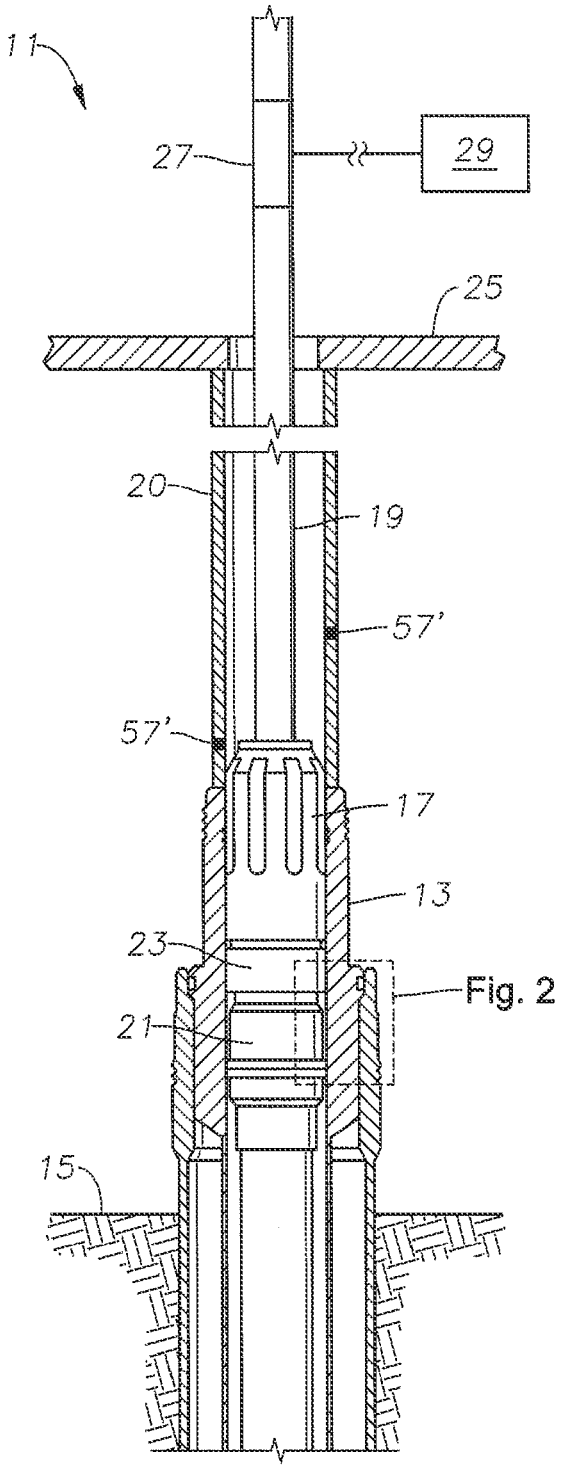
FIG. 1 is a schematic representation of a running tool suspended within a wellbore in accordance with an embodiment.

Referring to FIG. 1, a subsea tool system 11 is shown. Subsea tool system 11 includes a subsea wellhead 13 disposed at a sea floor 15. A running tool 17 is suspended within wellhead 13 on a landing or running string 19. A tubing or casing hanger 21, such as a tubing hanger, casing hanger, or the like, is coupled to a lower end of running tool 17. Running tool 17 may operate to set casing hanger 21 within wellhead 13 using a packoff or seal assembly 23. A string of casing is secured to the lower end of easing hanger 21. Landing string 19 extends from running tool 17 suspended within wellhead 13 up to and through a platform 25. Platform 25 is an operational platform located on a surface of a body of water and provides a working area for operators to conduct drilling and production activities through wellhead 13. In some embodiments, a riser string 20 may extend between the platform and the wellhead to provide a conduit for landing string 19 and other devices and/or substances to travel between wellhead 13 and platform 21. A communications sub 27 may be coupled inline with landing string 19 at platform 25. Communications sub 27 will be coupled inline with landing string 19 following arrival of running tool 17 at a desired location with wellhead 13.

In the illustrated embodiment, communications sub 27 may comprise a sub designed to transmit electric potential from an electrical power unit 29 located on platform 25 to landing string 19. Electrical power unit 29 may be located proximate to landing string 19 and communications sub 27 as illustrated or may be located further from landing string 19 and communications sub 27. Electrical power unit 29 may be coupled to communications sub 27 in a manner that allows transmission of electric potential from electrical power unit 29 to communications sub 27 while still allowing for rotation of landing string 19. In other embodiments, landing string 19 may not rotate. In an embodiment, communications sub 27 may generate electro-magnetic waves in response to input from electrical power unit 29. Communications sub 27 may then transmit the electro-magnetic waves through landing string 19. For example, electric power and communication may be supplied through a high efficiency contactless power coupling with a resonator as disclosed in U.S. Patent Application Publication No. 2011/0278018, filed May 12, 2010, entitled "Electrical Coupling Apparatus and Method," and incorporated herein by reference. Other exemplary embodiments may provide electric power and communication through inductive coupling such as that disclosed in U.S. patent application Ser. No. 12/908,123, filed Oct. 20, 2010, entitled "System and Method for Inductive Signal and Power Transfer from ROA to In-Riser Tools," incorporated by reference herein.

Figure 2:
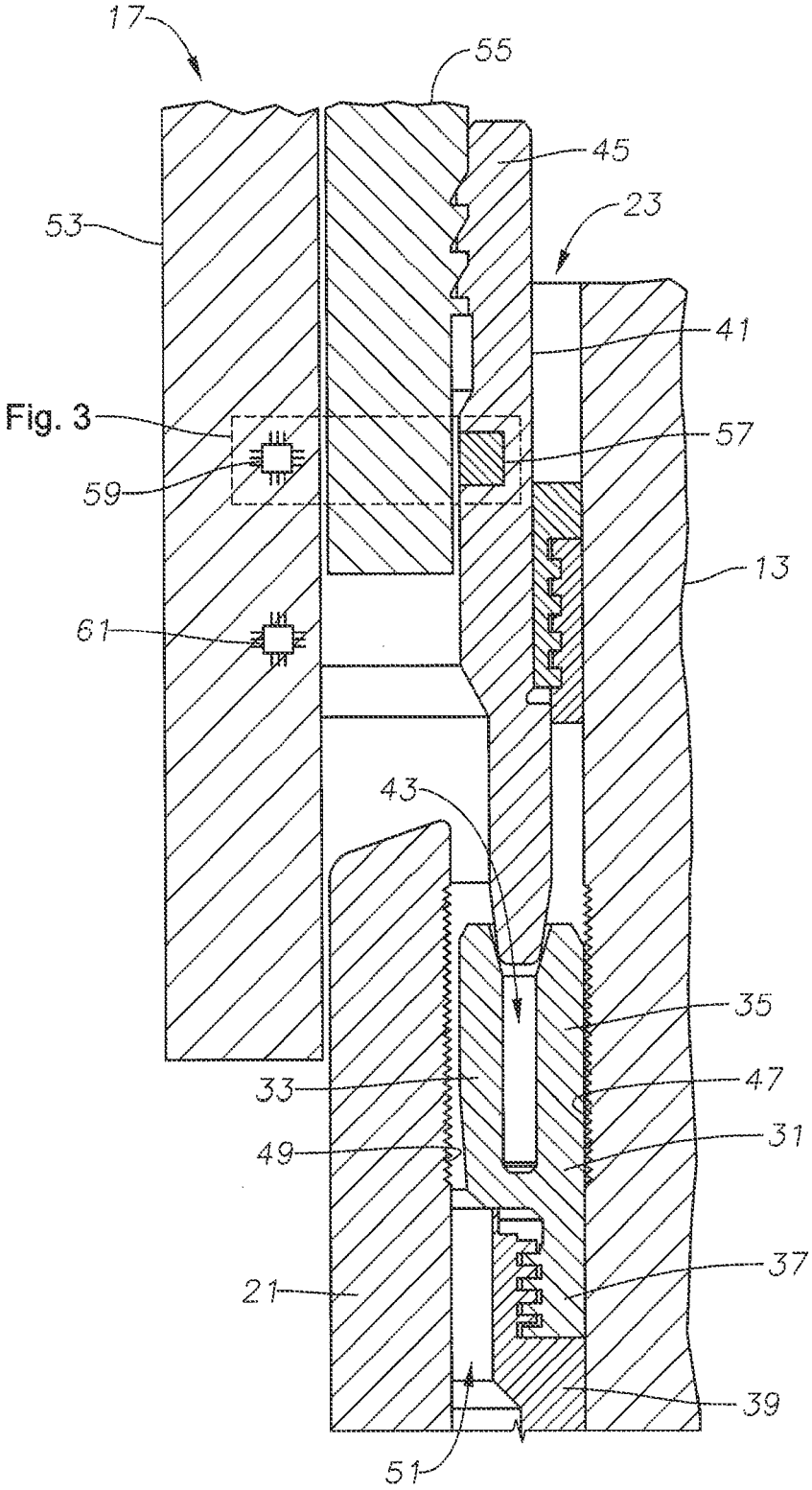
FIG. 2 is a schematic representation of a portion of the running tool of FIG. 1 having a seal assembly disposed between a tubing hanger and a wellhead in an unset position in accordance with an embodiment.

Referring to FIG. 2, portions of wellhead 13, casing hanger 21, running tool 17 and seal assembly 23 are shown. Seal assembly 23 may include a seal ring 31. Seal ring 31 may be an annular member having a U-shaped portion with seal ring legs 33, 35 and a lower leg 37. Lower leg 37 extends downward from the U-shaped portion. Lower leg 37 has the same inner and outer diameter as outer leg 35 in this embodiment. Lower leg 37 couples to a nose ring 39 of seal assembly 23. In the illustrated embodiment, nose ring 39 threads to lower leg 37 and has a lower end (not shown) that may land on a shoulder (not shown) of casing hanger 21, providing a reaction location for compression of seal assembly 23, as described in more detail below. Seal assembly 23 also includes an energizing ring 41. Energizing ring 41 may be an annular member having an axially lower end slightly larger than a slot 43 defined between seal ring legs 33, 35 of seal ring 31. Energizing ring 41 has an upper end 45 adapted to be releasably coupled to running tool 17 so that running tool 17 may run seal assembly 23 to the location shown in FIG. 2, and then operate energizing ring 41 to energize seal assembly 23.

Wellhead 13 and casing hanger 21 may have wickers 47, 49 formed on inner diameter and outer diameter surfaces of each respective member as shown. In the illustrated embodiment, wickers 47, 49 face each other across an annulus 51 into which seal assembly 23 is disposed. When seal ring 31 is disposed in annulus 51, an inner diameter surface of inner leg 33 may be proximate to wickers 49 and an outer diameter surface of outer leg 35 may be proximate to wicker 47. In the illustrated embodiment, running tool 17 includes a stem portion 53 and a piston portion 55. Piston portion 55 couples to energizing ring 41 at upper end 45 of energizing ring 41 and surrounds stern portion 53. Piston portion 55 is axially movable relative to stem portion 53 in response to tubing string weight, hydraulic pressure, or the like. Stem portion 53 may couple to tubing string 19 for rotation therewith. A person skilled in the art will recognize that the components of running tool 17 are shown schematically in FIG. 2 and may include any suitable components and configurations such that running tool 17 may set seal assembly 23.

Figure 4:
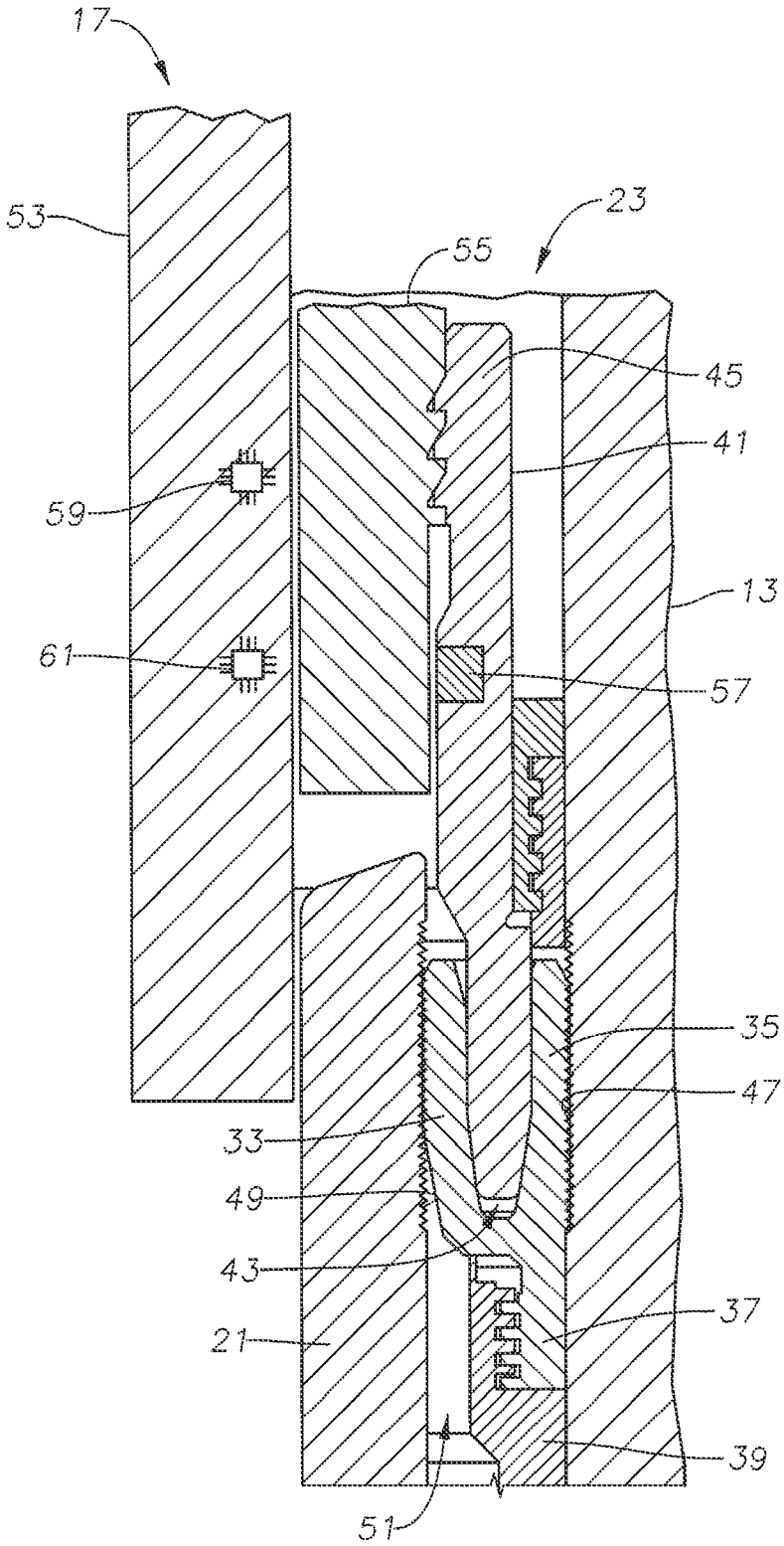
FIG. 4 is a schematic representation of a portion of the operational system of FIG. 1 illustrating the seal assembly disposed between the tubing hanger and the wellhead in a set position in accordance with an embodiment.

Energizing ring 41 includes a magnet 57, such as a rare earth magnet, mounted in a portion of energizing ring 41. Magnet 57 may be any suitable rare earth magnet, for example samarium cobalt or the like. An unset sensing device 59 may be mounted in stem portion 53 of running tool 17. Similarly, a set sensing device 61 may be mounted in stem portion. 53 of running tool 17. In the illustrated embodiment, unset sensing device 59 may be at a position axially higher than set sensing device 61. Unset and set sensing devices 59, 61 may be microchips, such as Giant Magneto-Restrictive (GMR) or Hall Effect sensing chips. In alternative embodiments, unset and set sensing devices 59, 61 may be hybrid magneto-optoelectronic devices having a magnetic tunnel junction and a vertical cavity surface emitting diode laser; the device modulates the amplitude of the laser output in response to changes in an external magnetic field. The modulation of the laser may be interpreted as positional feedback. In still other embodiments, unset and set sensing devices 59, 61 may be a reed switch, an electrical switch operated by an applied magnetic field. Reed switches include a pair of contacts formed on ferrous metal reeds sealed in a glass envelope that close in the presence of a magnetic field. In still another embodiment, unset and set sensing device 59, 61 may be a coil, such as a coil of copper wire adapted to receive a power source. During setting or energization of seal assembly 23, magnet 57 may be axially proximate to unset sensing device 59 as shown in FIG. 2 and set sensing device 61 as shown in FIG. 4. As disclosed above, power may be supplied to running tool 17 and sensing devices 59, 61 via electromagnetic (EM) data transmission as is known in the prior art. EM data transmission systems transmit low frequency EM waves using the well's tubing or casing as the transmission medium. Sensing devices 59, 61 receive the EM waves and convert the waves to electrical power for operation of sensing devices 59, 61. Similarly, sensing devices 59, 61 may generate EM waves that are transmitted through the tubing or casing string to the surface. In other exemplary embodiments, ultrasonic waves may be used. A person skilled in the art will recognize that many different subsea sealing arrangements May be used with the disclosed embodiments, provided each axially displaces a ring or member to energize the sealing arrangement.

Figure 3:
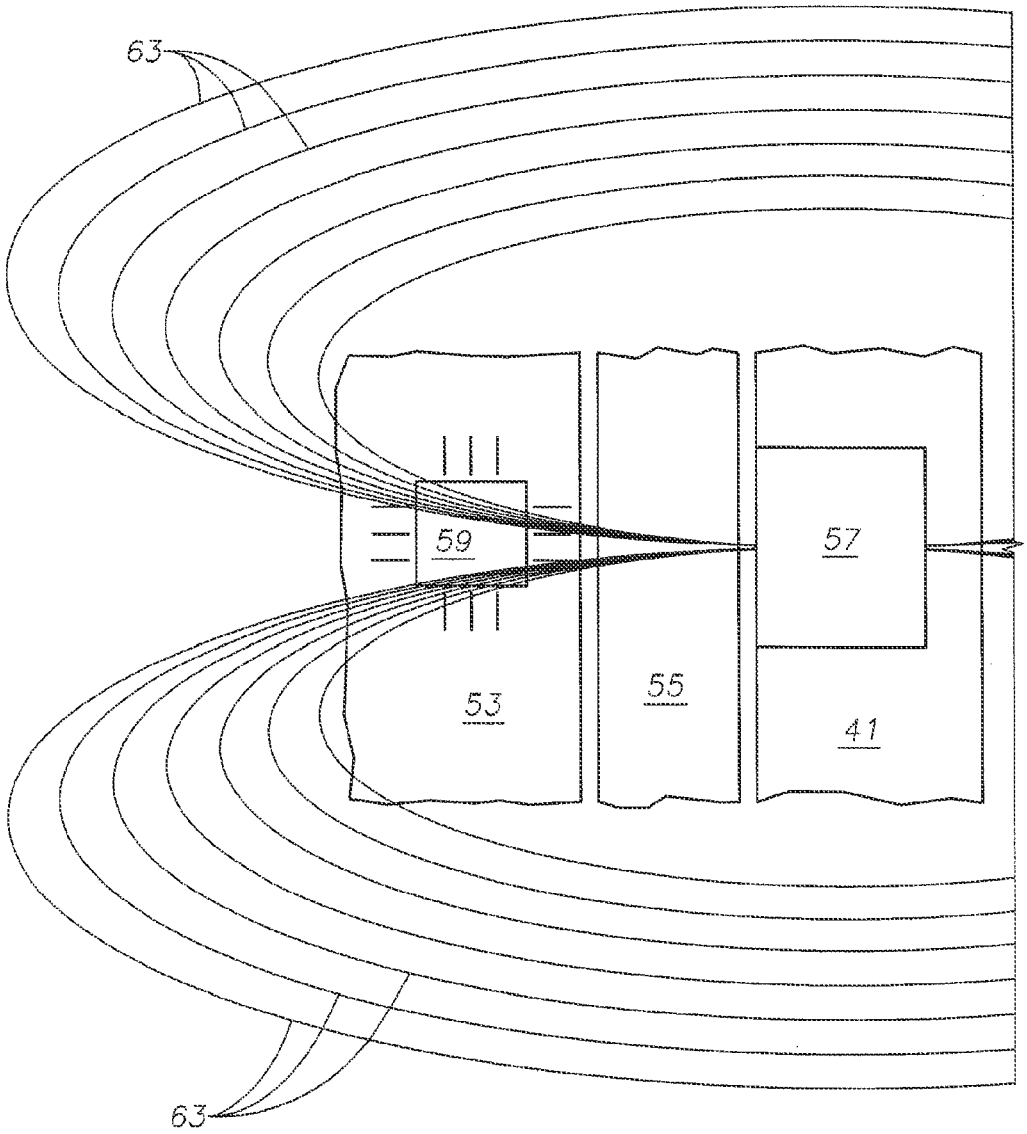
FIG. 3 is a schematic representation of a portion of FIG. 2 illustrating magnetic interaction between a rare earth magnet and a sensing device in accordance with an embodiment.

As shown in FIG. 3, magnet 57 may generate a magnetic field as illustrated by magnetic field lines 63. A person skilled in the art will understand that the magnetic field generated by magnet 57 may be shaped differently and is shown in FIG. 3 for illustrative purposes only. Magnet 57 may have a sufficient magnetic strength such that the magnetic field passes through unset sensing device 59 when energizing ring 41 is in the unset position of FIGS. 2 and 3. The magnetic field will generate a magnetic flux through unset sensing device 59. Unset sensing device 59 may detect the magnetic field of magnet 57 and communicate the detection to communications sub 27 (FIG. 1) and electrical power unit 29 (FIG. 1) located at the surface to indicate that energizing ring 41 is in the unset position with respect to running tool 17. Similarly, when energizing ring 41 is in the set position of FIG. 4, described in more detail below, the magnetic field of magnet 57 may pass through set sensing device 61. Set sensing device 61 may detect the magnetic field of magnet 57 and communicate the detection to communications sub 27 and electrical power unit 29 located at the surface to indicate that energizing ring 41 is in the set position with respect to running tool 17. A person skilled in the art will understand that communication of the detection by both set and unset sensing devices 61, 59 may be by any suitable means, including but not limited to the prior art methods disclosed above.

Seal assembly 23 is run to land and set as shown in FIG. 2 in a typical running operation. While running into the wellbore, the elements of seal assembly 23 are as illustrated in FIG. 2. An axial force is then applied to energizing ring 41 with piston portion 55 of running tool 17. Energizing ring 41 moves downward axially in response such that an end of energizing ring 41 applies a corresponding downward axial force to upper surfaces of seal ring legs 35, 37. Continued application of downward axial force to energizing ring 41 causes an end of energizing ring 19 to insert into slot 43 formed by seal ring legs 35, 37. As the end of energizing ring 41 inserts into slot 43, seal ring legs 35, 37 will deform radially into engagement with wickers 49, 47, respectively, as shown in FIG. 4. The inner diameter surface of seal ring leg 33 will then be deformed by wickers 49 of casing hanger 21, and the outer diameter surface of seal ring leg 35 will be deformed by wickers 47 of wellhead 13, forming a seal of annulus 51. As described above, when energizing ring 41 reaches this position, the magnetic field of magnet 57 will generate a magnetic flux through set sensing device 61. Set sensing device 61 may then communicate this to the surface as an indication that seal assembly 23 is properly set in a manner disclosed above.

A person skilled in the art will understand that other components configured to move relative to one another in downhole embodiments may have a combination of a magnet and one or more sensing devices as disclosed herein. In this manner, position of moving components and confirmation of successful operation of downhole components may be confirmed by placing sensing devices and rare earth magnets in the locations of desired movement. For example, in an embodiment, magnets 57' may be placed at various locations in riser 20. As running tool 17 moves past these magnets 57' a signal may be generated and sent to the surface in a manner similar to that described above. A person skilled in the art will also understand that axial positions, rotational positions and radial positions may be detected by the combination of components disclose herein. In this manner, the disclosed embodiments allow for use in any suitable wellhead member such as wear bushings, lockdown bushings, tubing hangers, casing hangers, and the like.

Accordingly, the disclosed embodiments provide numerous advantages. In addition, the disclosed embodiments provide remote feedback of status of riser tool and hanger lockdown status during installation, allowing for confirmation of proper landing and activation of in-riser members. The disclosed embodiments accomplish this task without requiring a dedicated power and signal umbilical. Thus, the disclosed embodiments are simpler and avoid risks associated with mechanical damage to a dedicated umbilical during installation operations. Still further, the disclosed embodiments reduce deployment time by removing the required element of deployment and retrieval of a dedicated umbilical in addition to the riser tool. A person skilled in the art will understand that the disclosed embodiments may also be adapted for use with a hydraulically powered running tool having a dedicated hydraulic umbilical. In these cases, electric power and communication signals may be transmitted within the hydraulic umbilical external to the production tubing.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review Of the foregoing description of preferred embodiments. Accordingly, it is appropriate that the appended claims be construed broadly and in a manner consistent with the scope of the invention.

What is claimed is:

1. A positional feedback system for sealing a hanger within a subsea wellhead with a hanger setting and sealing system, the feedback system comprising:

a seal assembly releasably coupled to a running tool, the seal assembly configured to be positioned between an outer diameter surface of the hanger and an inner diameter surface of the wellhead, the seal assembly having an upper portion that moves relative to a lower portion when the seal assembly is being moved from an unset to a set position to form a seal between the seal assembly and the inner and outer diameter surfaces of the wellhead and the hanger, respectively;

a magnet having a magnetic field, the magnet disposed on the upper portion of the seal assembly;

the running tool configured to set the hanger in the wellhead; and one or more sensing devices disposed on the running tool, the one or more sensing devices positioned in the magnetic field of the magnet in one or more of the set position and the unset position, the one or more sensing devices configured to communicate with a surface platform when the magnet moves relative to the one or more sensing devices, thereby sensing a change in the magnetic field due to said relative movement.

2. The positional feedback system of claim 1, wherein:

the running tool has a stem portion and a piston portion, the piston portion surrounding the stem portion and axially movable relative to the stem portion;

the upper portion of the seal assembly releasably coupled to the piston portion so that the upper portion moves axially in response to movement of the piston portion;

the one or more sensing devices positioned on the stem portion of the running tool; and the piston portion moves the upper portion from the unset to the set position, thereby moving the magnet proximate to the one or more sensing devices.

3. The positional feedback system of claim 2, wherein the one or more sensing devices comprise a set sensing device and an unset sensing device, both positioned on the stem portion of the running tool, the unset sensing device positioned axially above the set sensing device, the magnet positioned proximate to the unset sensing device in the unset position and proximate to the set sensing device in the set position.

4. The positional feedback system of claim 1, wherein the one or more sensing devices comprises an unset sensing device positioned to detect the magnetic field of the magnet when the upper portion of the seal assembly is in the unset position.

5. The positional feedback system of claim 1, wherein the one or more sensing devices comprises a set sensing device positioned to detect the magnetic field of the magnet when the upper portion of the seal assembly is in the set position.

6. The positional feedback system of claim 1, wherein:

the seal assembly lower portion comprises a seal ring and the seal assembly upper portion comprises an energizing ring, the energizing ring configured to be moved relative to the seal ring from an unset position to a set position to set the seal ring; and the magnet disposed on the energizing ring.

7. The positional feedback system of claim 1, wherein one or more riser magnets having separate magnetic fields are positioned in a riser extending from the subsea wellhead to the surface platform, and the one or more sensing devices are configured to communicate a current tool elevation with the surface platform when the one or more sensing devices passes through the separate magnetic fields of the one or more riser magnets.

8. A positional feedback system for sealing a hanger within a subsea wellhead with hanger setting and sealing system, tile system comprising:

a seal assembly releasably coupled to a running tool, the seal assembly configured to be positioned between an outer diameter surface of the hanger and an inner diameter surface of the wellhead, the seal assembly having a seal ring and an energizing ring, the energizing ring configured to be moved relative to the seal ring from an unset position to a set position to set the seal ring to form a seal between the seal ring and the inner and outer diameter surfaces of the wellhead arid the hanger, respectively;

a magnet having a magnetic field, the magnet disposed on the energizing ring of the seal assembly;

the running tool configured to set the hanger in tile wellhead; and one or more sensing devices disposed on the running tool, the one or more sensing devices positioned in the magnetic field of the magnet in one or more of the set position and the unset position, the one or more sensing devices configured to communicate with a surface platform when the magnet moves relative to the one or more sensing devices, thereby sensing a change in the magnetic field due to said relative movement.

9. The positional feedback system of claim 8, wherein:

the running tool has a stem portion and a piston portion, the piston portion surrounding the stem portion and axially movable relative to the stem portion;

the energizing ring of the seal assembly releasably coupled to the piston portion so that the energizing ring moves axially in response to movement of the piston portion;

the one or more sensing devices positioned on the stem portion of the running tool; and the piston portion moves the energizing ring from the unset to the set position, thereby moving the magnet proximate to the one or more sensing devices.

10. The positional feedback system of claim 9, wherein the one or more sensing devices comprise a set sensing device and an unset sensing device, both positioned on the stem portion of the running tool, the unset sensing device positioned axially above the set sensing device, the magnet positioned proximate to the upset sensing device in the unset position and proximate to the set sensing device in the set position.

11. The positional feedback system of claim 8, wherein the one or more sensing devices comprises an unset sensing device positioned to detect the magnetic field of the magnet when the energizing ring is in the unset position.

12. The positional feedback system of claim 8, wherein the one or more sensing devices comprises a set sensing device positioned to detect the magnetic field of the magnet when the energizing ring is in the set position.

13. A method for setting a seal assembly between a hanger and a subsea wellhead member, the method comprising:

(a) mounting a magnet to upper portion of the seal assembly, and one or more sensing devices on a running tool;

(b) with the running tool, positioning the seal assembly between an outer diameter surface of the hanger and an inner diameter surface of the wellhead;

(c) moving the upper portion relative to a lower portion of the seal assembly from an unset position to a set position to set the seal assembly between the inner and outer diameter surfaces of the wellhead member and the hanger, respectively;

(d) moving a magnetic field of the magnet through the one or more sensing devices disposed on running tool; and (e) communicating a signal to the surface platform in response to passing the magnetic field of the magnet through the one or more sensing devices, the signal indicating positional location of the energizing ring.

14. A method of claim 13, wherein the running tool has a stem portion and a piston portion, the piston portion surrounding the stem portion and axially movable relative to the stem portion, the method further comprising:

releasably coupling the upper portion to the piston portion so that the upper portion moves axially in response to movement of the piston portion;

positioning the one or more sensing devices on the stem portion of the running tool; and moving the piston portion to move the upper portion from the unset to the set position, thereby moving the magnet proximate to the one or more sensing device.

15. The method of claim 14, wherein the one or more sensing devices comprise a set sensing device and an unset sensing device, the method further comprising positioning the unset sensing device and the set sensing device on the stem portion of the running tool, the magnet positioned proximate to the unset sensing device in the unset position and proximate to the set sensing device in the set position.

16. The method of claim 15, further comprising positioning the unset sensing device axially spaced apart from the set sensing device.

17. The method of claim 13, wherein the one or more sensing devices comprises an unset sensing device and the upper portion of the seal assembly comprises an energizing ring, the method comprising positioning the unset sensing device to detect the magnetic field of the magnet when the energizing ring is in the unset position.

18. The method of claim 13, wherein the one or more sensing devices comprises a set sensing device and the upper portion of the seal assembly comprises an energizing ring, the method comprising positioning the set sensing device to detect the magnetic field of the magnet when the energizing ring is in the set position.

19. The method of claim 13, wherein the upper portion of the seal assembly comprises an energizing ring and step (a) comprises mounting the magnet to the energizing ring.

20. The method of claim 13, wherein step (e) further comprises transmitting electro-magnetic waves through a running string coupled to the running tool to power the sensing devices.

21. The method of claim 13, wherein step (e) further comprises generating an electro-magnetic signal with the sensing device in response to movement of the magnetic field of the magnet through the sensing device and transmitting the electro-magnetic signal to a surface through a running string coupled to the running tool.

* * * * *